US005181854A

United States Patent [19]

Masuda

[11] Patent Number: 5,181,854

[45] Date of Patent: Jan. 26, 1993

[54] PRESS-CONTACT TYPE ELECTRIC CONNECTOR FOR A FLAT, FLEXIBLE CABLE

[75] Inventor: Katsuyoshi Masuda, Ayase, Japan

[73] Assignee: Molex Incorporated, Lisle, Ill.

[21] Appl. No.: 860,846

[22] Filed: Mar. 30, 1992

[30] Foreign Application Priority Data

Apr. 15, 1991 [JP] Japan ..... 3-33924[U]

[51] Int. Cl.[5] ..... H01R 9/09

[52] U.S. Cl. ..... 439/67; 439/493; 439/567

[58] Field of Search ..... 439/65, 67, 77, 329, 439/493, 567

[56] References Cited

U.S. PATENT DOCUMENTS

| | | | |
|---|---|---|---|
| 4,169,641 | 10/1979 | Olsson | 439/493 |
| 4,252,389 | 2/1981 | Olsson | 439/493 |
| 4,252,392 | 3/1981 | Whiteman, Jr. | 439/67 |
| 4,358,172 | 11/1982 | Narozny | 439/493 |
| 4,871,315 | 10/1989 | Noschese | 439/67 |

*Primary Examiner*—Neil Abrams
*Attorney, Agent, or Firm*—Stephen Z. Weiss

[57] ABSTRACT

The object of the present invention is to provide a solderless connector which permits the exact positioning of a flat, flexible cable in its housing. An electric connector comprising a housing having a resilient contact piece integrally connected therewith, permitting insertion of a flat, flexible cable to put the conductor surface of said flat, flexible cable in registration with selected part of the circuit pattern on a printed circuit board, said resilient contact piece being adapted to push the conductor surface of said flat, flexible cable against said selected part of the circuit pattern, is characterized in that said housing has a groove made on its front portion, thereby accommodating the leading edge of said flat, flexible cable when inserted in said housing, and that said housing has a lock piece integrally connected to the vicinity of a cable slot, thereby causing said lock piece to be yieldingly bent, pushing a side of said flat, flexible cable when said housing is fixed to said printed circuit board with the aid of associated pins.

4 Claims, 4 Drawing Sheets

PRESS-CONTACT TYPE ELECTRIC CONNECTOR FOR A FLAT, FLEXIBLE CABLE

FIELD OF THE INVENTION

The present invention relates to an electric connector, and more particularly to an improvement of an electric connector for permitting a solderless connection between the conductors of a flat, flexible cable and a circuit pattern on a printed circuit board by pressing the conductors of the flat, flexible cable against the circuit pattern.

BACKGROUND OF INVENTION

As is well known, flat, flexible cables are connected to printed circuit patterns with the aid of electric connectors. A conventional electric connector is composed of male and female parts, which are soldered to the exposed conductors of the stripped end of a flat, flexible cable and to selected conductors of a printed circuit pattern respectively. A desired electric connection can be made by coupling the male and female parts of the electric connector. Soldering, however, is a tedious and time-consuming work. In an attempt to eliminate such tedious and time-consuming work a solderless connection in the form of press contact was proposed, as for example in U.S. Pat. Nos. 4,169,641, 4,252,389, 4,252,392, 4,358,172, 4,634,195 and others. This type of solderless connector comprises a housing having a resilient contact piece integrally connected therewith, permitting insertion of a flat, flexible cable to place the conductor surface of the flat, flexible cable in registration with selected part of the circuit pattern on a printed circuit board. The resilient contact piece is adapted to push the conductor surface of the flat, flexible cable against the selected parts of the circuit pattern.

The solderless connectors in the prior art, however, have some disadvantages. First, none have cable positioning means to assure that the stripped end of a flat, flexible cable is put in correct position in the connector housing. It is relatively difficult to put a flat, flexible cable in correct position in the connector housing, and if it is put in a wrong position, a poor electric connection will result. Second, the connector housings of the prior art can be fixed to a printed circuit board by fitting the pins or pegs of the connector housings in corresponding holes of the printed circuit board, but these connector housings have no means to positively hold the flat cable therein. The flat cable is held only by a resilient contact piece, which pushes the end of the flat cable against the printed board. If undesired external force should be applied to the flat cable, it is liable to cause the flat cable to change in position. Thus, incomplete electric connection may result, leading to malfunction of the associated electric apparatus.

In view of the above, one object of the present invention is to provide a solderless connector which permits the exact positioning of a flat, flexible cable in the connector housing, particularly in the area in which a required electric connection is to made between the cable and the printed circuit pattern.

Another object of the present invention is to provide a solderless connector which is capable of positively holding a flat, flexible cable in the connector housing, thus preventing movement of the flat cable, which otherwise, would be caused by external force.

SUMMARY OF THE INVENTION

To attain these objects an electric connector for connecting a flat, flexible cable to a printed circuit board is provided comprising a housing having front and rear portions and a slot in the housing front portion permitting insertion of a flat, flexible cable. A resilient contact piece integrally connected to the housing is adapted to push the conductor surface of the flat, flexible cable against and in registration with selected parts of the circuit pattern on a printed circuit board. The housing has a groove formed in its rear portion to accommodate the leading edge of said flat, flexible cable when inserted in said housing. The housing also has a flexible lock piece integrally connected to the housing in the vicinity of the cable slot to push the rear side of the flat, flexible cable against the housing preventing the removal of the cable from the housing. The free end of said resilient contact piece may have notches formed thereon.

Other objects and advantages of the present invention will be understood from the following description of solderless connectors according to the embodiments of the present invention.

BRIEF DESCRIPTION OF THE DRAWINGS

The invention can be more fully understood from the following detailed description thereof in connection with accompanying drawings described as follows.

DETAILED DESCRIPTION OF THE PREFERRED EMBODIMENTS

FIGS. 1 to 6 show a solderless connector 3 according to a first embodiment of the present invention. It permits a solderless connection between the conductors 2A of a flat, flexible cable 2 and the circuit pattern 1A of a printed circuit board 1 in the form of press contact.

Figure 1:
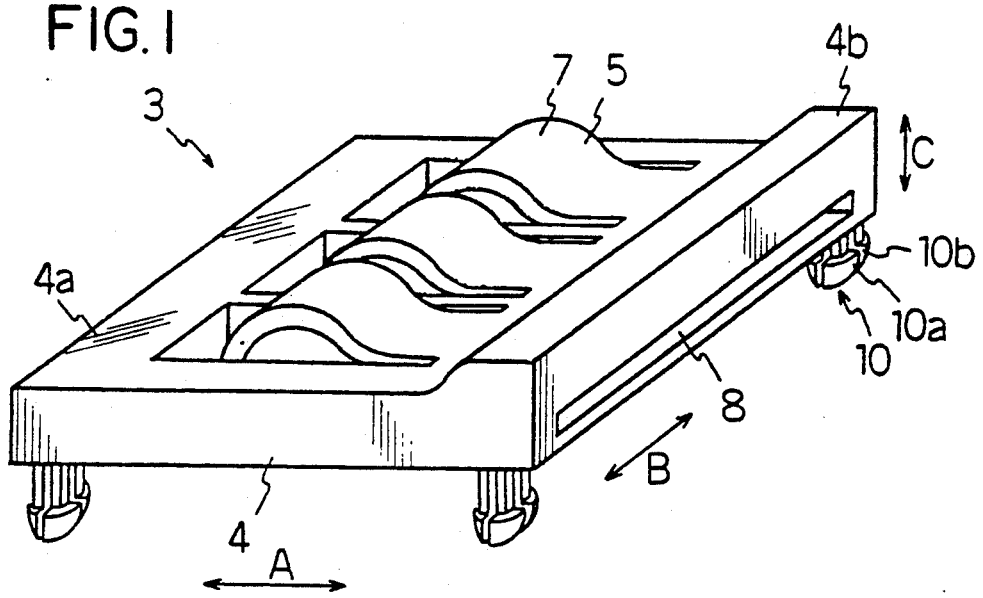
FIG. 1 is a perspective top view of a solderless connector according to a first embodiment of the present invention.
Figure 2:
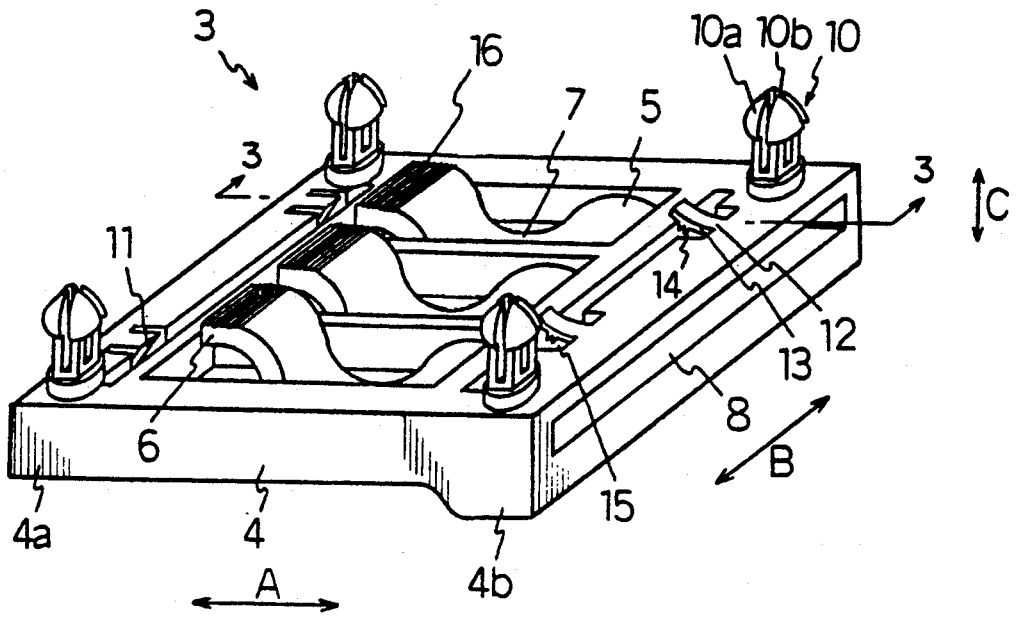
FIG. 2 is a perspective bottom view of the solderless connector of FIG. 1.
Figure 3:
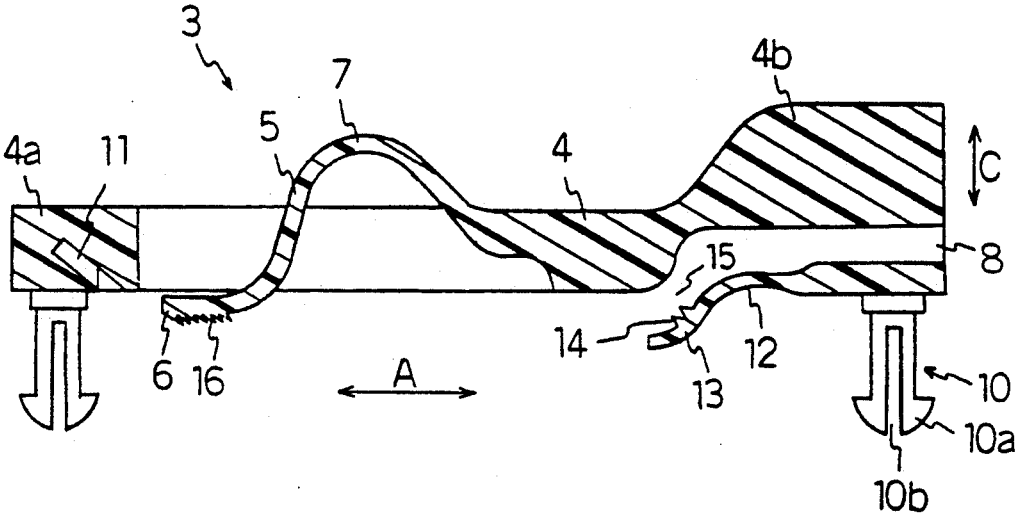
FIG. 3 is a section of the solderless connector taken along the line 3—3 in FIG. 2.
Figure 4:
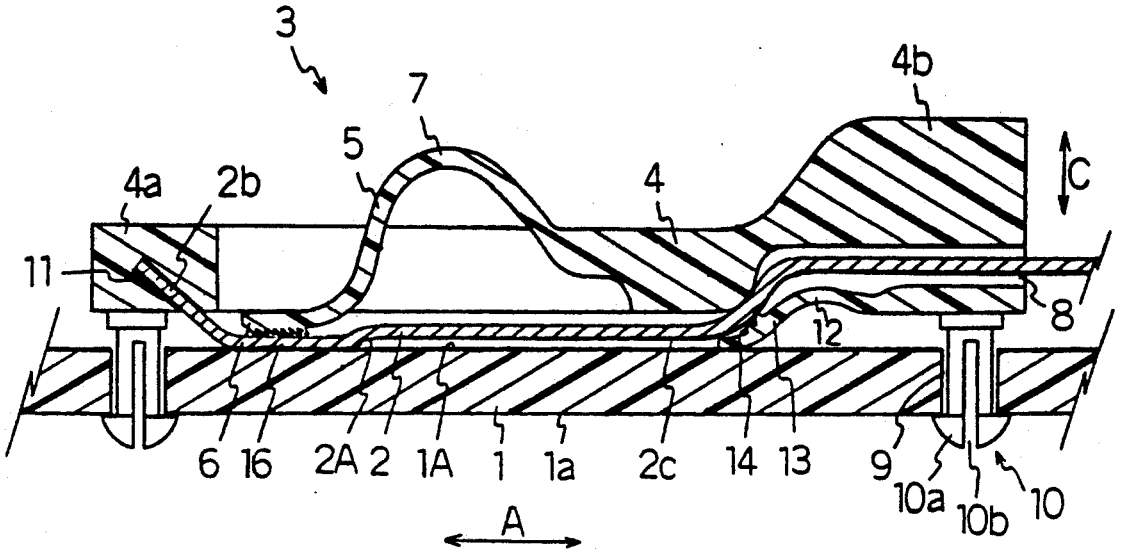
FIG. 4 is a similar section, but showing how a flat, flexible cable is connected when the solderless connector is applied to a printed circuit board.
Figure 5:
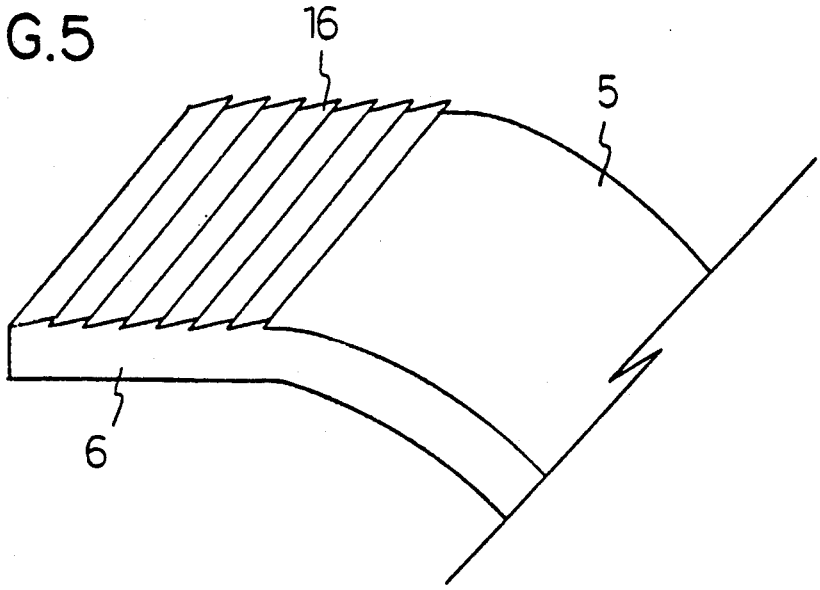
FIG. 5 is an enlarged perspective view of the free end of the resilient contact piece of the solderless connector.
Figure 6:
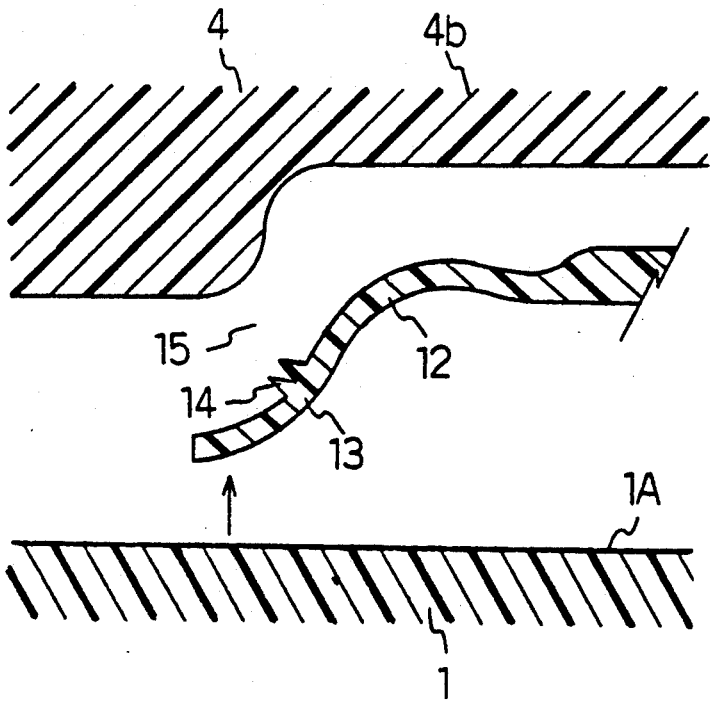
FIG. 6 is an enlarged section, showing the lock piece of the solderless connector.

As best seen from FIGS. 1 and 2, a plurality of resilient contact pieces 5 are arranged parallel in lateral directions B, and are integrally connected to the lateral side of a housing 4 in the form of cantilevered arms, extending parallel in the longitudinal direction A. These resilient contact pieces 5 are wavy in shape. The free end of each resilient contact piece 5 constitutes a press contact section 6, which extends from a rising section 7.

The housing 4 has a cable slot 8 passing through its rear portion, permitting insertion of a flat, flexible cable 2 into housing 4.

As best seen from FIG. 2, split pins 10 are fixed to the four corners of the housing 4 for attaching the housing 4 to a printed circuit board 1, which has holes 9 to catch the pins 10 when inserted therein.

Each split pin 10 has four enlarged lock quarters 10*a* separated by slots 10*b*, thereby providing resiliency. When the split pin head is inserted in a corresponding hole 9, its diameter reduces yieldingly, thereby allowing the split pin head to pass through the hole 9 and ıesiliently return to its original, stress-free condition, so that the four enlarged lock quarters 10*a* may be caught by the rear side 1*a* of the printed circuit board 1 around the hole 9. Thus, the connector housing 4 is attached to the printed circuit board 1.

Housing 4 has a groove 11 made on its front portion 4*a*, thereby accommodating the leading edge of a flat, flexible cable 2 when inserted in the housing 4. Specifically, after the cable 2 is inserted from the cable slot 8 into the connector housing 4, the cable 2 extends longitudinally on the bottom side of the connector housing 4. The end 2*b* of the cable 2 is pushed in the groove 11 of the front portion 4*a* of the conductor housing 4, and then the cable 2 is automatically put in correct position in the conductor housing 4.

Housing 4 has a lock piece 12 intergrally connected in the vicinity of the cable slot 8 of the housing 4 in the form of a short cantilevered arm. Specifically, one ned of the lock piece 12 is integrally connected to the housing 4 whereas the free end of the lock piece 12 constitutes a locking arm section 13, which has points 14 formed thereon. A cable insertion gap 15 which is large enough to permit insertion of the cable 2 is defined between the lock piece 12 and the bottom side of the connector housing 4.

When the connector housing 4 having a flat, flexible cable 2 inserted in the cable insertion gap 15, is fixed to a printed circuit board 1, the lock piece 12 is yieldingly bent upwards by the printed circuit board 1 so that the rear side 2C of the cable is pushed towards the ceiling of the connector housing 4. When the flat, flexible cable 2 is inserted in the insertion gap 15, the cable 2 cannot be held by the connector housing 4, but when the connector housing 4 is fixed to the printed circuit board 1, the cable 2 is pinched between the ceiling of the connector housing 4 and the upper surface of the lock piece 12. Thus, the cable 2 can be positively held, preventing it from moving away from a correct position even if undesired external force should be applied thereto. Preferably the lock piece 15 may having locking points 14 formed thereon.

One end of the flat, flexible cable 2 is stripped on one side to expose its conductors 2A whereas the other end of the cable 2 is connector to an associated electric apparatus.

The manner in which the solderless connector 3 is used by first inserting one end 2*b* of a flat, flexible cable 2 into the cable slot 8 of the connector housing 4 to pass through the insertion gap 15 and pass by the free contact end 6 of the resilient contact piece 5. The end 2*b* of the cable 2 is inserted in the groove 11 of the front portion 4*a* of the connector housing 4.

Next, the connector housing 4 having the cable 2 inserted therein is fixed to a printed circuit board 1 by inserting its split pins 10 into corresponding holes 9 of the printed circuit board 1. Thus, the connector housing 4 is positively fixed to the printed circuit board 1, and at the same time, the exposed conductors 2A of the cable 2 are pushed against the printed circuit pattern 1A of the printed circuit board 1 by the resilient contact piece 5 to make electrical contact therebetween. Also, at the same time, the lock piece 12 positively catches the cable 2 in position, preventing it from moving from the correct position.

Figure 7:
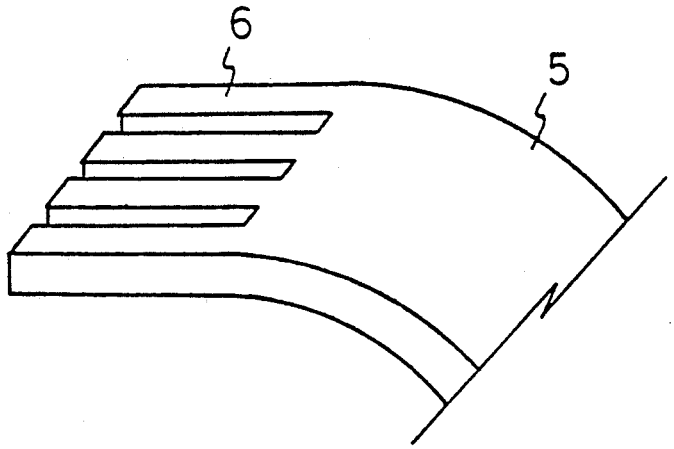
FIG. 7 is an enlarged perspective view of the free end of the resilient contact piece of a solderless connector according to a second embodiment of the present invention.

Referring to FIG. 7, a solderless connector according to the second embodiment of the present invention is shown. Specifically, the feature of this particular embodiment resides in the press contact portion 6 of the resilient contact piece 5. It has a plurality of parallel slits.

Figure 8:
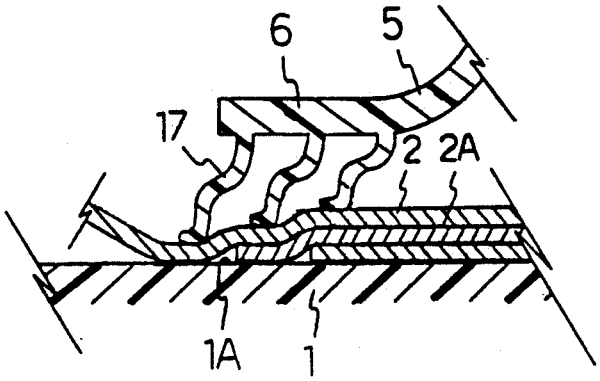
FIG. 8 is an enlarged section, showing the lock piece of a solderless connector according to a third embodiment of the present invention.

Referring to FIG. 8, a solderless connector according to the third embodiment of the present invention is shown. The feature of this particular embodiment resides in the press contact portion 6 of the resilient contact piece 5. It has a plurality of feet 17 to push a plurality of flat, flexible cables 2 laid on each other against a printed circuit board 1.

As may be understood from the above, a flat, flexible cable can be put in correct position in the connector housing with the aid of the groove in the front portion of the connector housing, thereby assuring good electrical contact between the cable and the printed circuit pattern in position. When the connector housing is fixed to the printed circuit board, the cable conductor is press-contacted to the printed circuit pattern by the resilient contact piece, and the cable is positively held in correct position by the lock piece, thus preventing undesired movement of the cable from the correct position which otherwise, would be caused if an external force should be applied to the cable.

Numerous modifications and variation of the present invention are possible in light of the above teachings. It is therefore to be understood that within the scope of the appended claims, the present invention may be practiced otherwise than as specifically described herein above.

We claim:

1. An electric connector for connecting a flat, flexible cable to a printed circuit board comprising:

a housing having front and rear portions, a slot in the housing front portion permitting insertion of a flat, flexible cable, a resilient contact piece integrally connected therewith and adapted to push the conductor surface of said flat, flexible cable against and in registration with selected part of the circuit pattern on a printed circuit board, characterized in that:

said housing having a groove formed in its rear portion to accommodate the leading edge of said flat, flexible cable when inserted in said housing, and having a flexible lock piece integrally connected to the housing in the vicinity of the cable slot, whereby said lock piece can push a side of said flat, flexible cable against the housing preventing the removal of the cable from the housing.

2. An electric connector according to claim 1, wherein said lock piece has locking points formed thereon.

3. An electric connector according to claim 1, wherein the free end of said resilient contact piece has notches formed thereon.

4. An electric connector according to claim 1, wherein said lock piece is positioned so that when the connector is fixed to the printed circuit board the lock piece first contacts the printed circuit board which forces the lock piece against a side of said flat, flexible cable.

* * * * *